US006389605B2

(12) United States Patent
Srivastava

(10) Patent No.: US 6,389,605 B2
(45) Date of Patent: May 21, 2002

(54) WRAP BELT

(76) Inventor: Priti Srivastava, 143 Juniper Hill Rd., White Plains, NY (US) 10607

( * ) Notice: Subject to any disclaimer, the term of this patent is extended or adjusted under 35 U.S.C. 154(b) by 0 days.

(21) Appl. No.: 09/747,042

(22) Filed: Dec. 23, 2000

Related U.S. Application Data

(60) Provisional application No. 60/171,560, filed on Dec. 23, 1999.

(51) Int. Cl.[7] ..... A41F 9/00
(52) U.S. Cl. ..... 2/312; 2/311; 2/338
(58) Field of Search ..... 2/312, 323, 342, 2/311, 338, 318, 339, 321, 341

(56) References Cited

U.S. PATENT DOCUMENTS

| | | | | | |
|---|---|---|---|---|---|
| 899,831 | A | * | 9/1908 | Mastele | |
| 1,237,660 | A | * | 8/1917 | Lakin | |
| 1,549,672 | A | * | 8/1925 | Lazier | |
| 2,663,026 | A | * | 12/1953 | Arnold | 2/229 |
| 3,259,916 | A | * | 7/1966 | Stepniak | 2/323 |
| 4,578,824 | A | | 4/1986 | Waldron | 2/96 |
| 4,724,548 | A | * | 2/1988 | London | 2/338 |
| 5,044,049 | A | | 9/1991 | Owens | 24/182 |
| 5,205,450 | A | | 4/1993 | Derosier | |
| 5,638,550 | A | * | 6/1997 | Hube | 2/311 |
| 5,702,279 | A | | 12/1997 | Brown | 441/94 |
| D389,287 | S | * | 1/1998 | Vanwinkle | D2/627 |
| 6,006,364 | A | * | 12/1999 | Newsom et al. | 2/323 |
| 6,026,515 | A | | 2/2000 | Neilson | 2/244 |
| 6,026,516 | A | * | 2/2000 | Dacyshyn | 2/323 |
| 6,085,356 | A | * | 7/2000 | Redmond, Sr. | 2/237 |
| 6,163,937 | A | * | 12/2000 | McKinnis et al. | 24/302 |

* cited by examiner

*Primary Examiner*—John J. Calvert
*Assistant Examiner*—Alissa L. Hoey

(57) ABSTRACT

A novel form of belt is presented where the two ends of the belt can be attached directly to a wearer's clothing instead of the belt closing on itself like a conventional belt. Two fastening means such as commercially available vest-clips are attached to the two extremities of a flexible length of belting material. A buckle or other adjusting means may be provided for varying the length of the wrap belt. In use, the wearer first attaches one end of the belt to a selected position on her article of clothing; she then wraps the belt around her torso one or more times; finally, she fastens the other end of the belt to a second selected position on her clothing. She may adjust the length of the belt before, or during or after wearing the belt.

16 Claims, 3 Drawing Sheets

WRAP BELT (A provisional patent application, No. 60/171,560 for this invention was filed on Dec. 23, 1999 for inventor Priti Srivastava. The benefit of the filing date of Dec. 23, 1999 is requested for the current patent application).

FIELD OF THE INVENTION

This invention relates to fashion accessories, specifically to a novel wrap belt.

DISCUSSION OF PRIOR ART

Many varieties of belts are available on the market to secure articles of clothing more firmly on a wearer's body. These belts can range from very simple to highly decorative styles. For instance, there are belts that consist simply of a length of fabric that can be tied around the waist of a wearer as in the case of bath robe ties. At the other extreme are the very decorative belts made of a rare leather and furnished with an elaborate buckle. Then there are high fashion belts that are designed to encircle the waist of a user multiple times before they are closed. The list goes on. All these different varieties of belts have one feature in common: they require the belt to close upon itself. In other words, the belt forms a closed loop. This restriction of having a closed loop results in disadvantages that the current invention purports to overcome. When a closed-loop belt is used on a dress that does not have belt loops, the dress and the belt behave independently. So the dress can move around separately from the belt and get uncomfortably and unattractively bunched. The belt can also move upwards or downwards with respect to the dress and not remain in the original position intended by the user. A closed loop belt also has disadvantages when worn with trousers or jeans. Since a conventional belt completely encircles the waist, it has to be unbuckled each time the wearer needs to remove their trousers or jeans. This can be a nuisance, for instance, when shopping for new clothes. Another disadvantage of a closed loop belt is that it can create an uncomfortable and sometimes unattractive bulk at the midriff. Additionally, a closed loop belt is restricted in use at the waist; it cannot, for instance, be used to hold a shoulder wrap (or a pashmina) in place. Also, it cannot be used to secure a sarong.

"Vest Scrunchers" have existed in the market for several years. They are worn on loose clothing along the waist and usually on the back of the article of clothing. Their purpose is to help tighten the loose article of clothing on the waist of the wearer. They consist of a piece of fabric (usually elastic; about 6.0 inches long and about 1.0 inch wide) with a clip at each of the two ends. These two clips can be used to grab the article of clothing in a way that the article of clothing is made to better conform to the body of the wearer. While the "vest scruncher" does not require a closed loop, it serves a different purpose from a belt and is, therefore, different from the wrap belt of this invention. Also, the vest scruncher is too short to be considered a belt. Additionally, it is not adjustable beyond the elasticity afforded by the fabric. Moreover, it is not intended to be used on trousers or skirts.

For the sake of completeness, a brief mention of some relevant prior art devices is provided. Many of these prior art devices are different from the traditional closed-loop belts. However, none of these prior art devices addresses the advantages of the wrap belt of this invention.

U.S. Pat. No. 899,831 by Mastele describes a belt comprising two semi-circular metallic straps connected together by a plurality of coil springs to form a belt for encircling the waistband of a pair of trousers.

U.S. Pat. No. 1,237,660 by Lakin discloses useful improvements in elastic ligatures intended to exert contractile pressure on the limb for a useful purpose, such as supporting a hose leg.

U.S. Pat. No. 2,663,026 by Arnold presents a shirt hold-down device which in combination with the shirt and trousers of a wearer restrain the shirt from creeping up and bulging.

U.S. Pat. No. 6,026,516 by Dacyshyn provides a novel pair of suspenders for being detachably secured to a pair of pants. U.S. Pat. No. 1,549,672 by Lazier also describes a novel suspender.

U.S. Pat. No. 6,163,937 by McKinnis et al. and U.S. Pat. No. 6,006,364 by Newsom et al. describe devices for connecting together straps worn near opposite shoulders.

U.S. Pat. No. 5,638,550 by Hube presents an expandable, inflatable, adjustable belt comprising an inner-tube to which an air intake and release mechanism are attached.

U.S. Pat. No. Des. 389,287 shows the ornamental design for an apparel sash.

OBJECTS AND ADVANTAGES

Accordingly, it is the object of this invention to present a novel form of belt where the two ends of the belt can be attached to a wearer's clothing instead of forming a closed loop.

It is also the object of this invention to present a novel form of belt that reduces the movement of clothing with respect to the belt thereby preserving the look intended by the wearer.

An additional object of this invention is to present a belt that is comfortable. Unlike traditional closed-loop belts, the belt of this invention does not need to be tightened uncomfortably for it to work.

It is yet another object of this invention to present a belt that does not need to be unbuckled and rebuckled each time one needs to remove the article of clothing the belt is attached to.

It is yet another object of the invention to describe a belt that does not cause an unattractive and uncomfortable bulk at the midriff. Unlike conventional belts, the belt of the current invention does not close at the midriff and does not position a hefty buckle at the midriff.

It is a further object of this invention to present a belt that can be used to secure other articles of clothing such as a sarong or a shawl.

It is also the object of this invention to present a belt that is very trendy and attractive. This advantage is of particular significance in the fashion accessory industry which is highly receptive to innovative new items and always hungry for the next new thing.

DRAWING FIGURES

REFERENCE NUMERALS IN DRAWINGS

Figure 1:
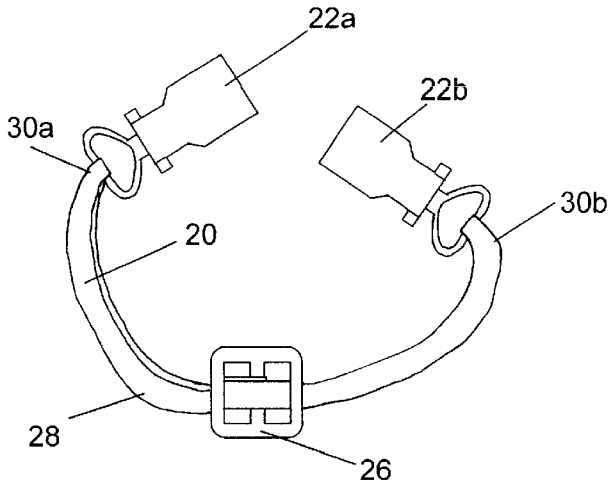
FIG. 1 illustrates a preferred embodiment of the wrap belt.

20 Length of belt material
22*a* and 22*b* Vest-clips used to grab clothing
26 Buckle used to vary length of belt
28 Wrap belt
30*a* and 30*b* Portions of belt material nearest the vest-clips
34 Anchor for attaching belt material to vest-clip
36 Hinge on vest-clip
38 Jaw cover of vest-clip used to open and close the jaws
42 Upperjaw of vest-clip
44 Lower jaw of vest-clip
46 Safety pin
47 Fold on garment of wearer
48 Torso of wearer
49 Loose garment on torso of wearer
50 Pair of trousers
52*a,* 52*b,* 52*c,* 52*d* Belt-loops on front of a pair of trousers
54 Closure on a pair of trousers
56 Wrap shawl
58 Neck of wearer
60 Shoulder of wearer
62 Extra vest-clip on wrap belt

SUMMARY

The present invention provides a wrap belt that attaches itself directly to a wearer's clothing. The two ends of the belt are provided with fastening means such as vest-clips or safety pins or claw pins or other equivalent means that will allow the belt to attach itself securely to the wearer's clothes. The belt may be made of variable length by including one or more buckles such as those provided on the straps of carry-on luggage to adjust their length. Instead of a buckle, other means for adjustment, Velcro(TM) for instance, may be used.

In use, the two ends of the belt grab on to two portions of the wearer's clothing. In alternative embodiments, the belt may attach to the wearer's clothing at more than two places.

DESCRIPTION OF THE INVENTION

Various aspects of the present invention will evolve from the following detailed description of the currently preferred embodiment thereof which should be taken in conjunction with the prior described drawings.

FIG. 1 shows an embodiment of wrap belt 28 of this invention. It consists of a length of belt material 20 such as fabric, leather, etc. with two vest-clips 22*a* and 22*b* at its two extremities 30*a* and 30*b*. A buckle 26 may be used to allow the length of the belt 28 to be adjusted. If buckle 26 is used, then the extremity 30*a* is movably attached to vest-clip 22*a* while extremity 30*b* is immovably attached to vest-clip 22*b*. This is done in the same manner that adjustable luggage straps are attached to a piece of luggage . A second buckle may be used to further adjust the length of belt 28. In that case, end 30*b* may also be movably attached to clip 22*b*.

Figure 2:
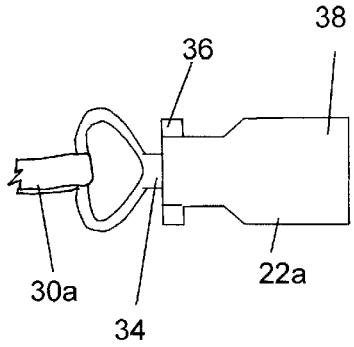
FIG. 2 is a detailed top view of a vest-clip.

FIG. 2 shows the top view of a commercially available vest-clip 22*a*. The end 30*a* of belt material 20 is looped around the anchor 34 of clip 22*a*. Anchor 34 has a hinge 36 that allows jaw cover 38 to rotate open and shut about the hinge.

Figure 3:
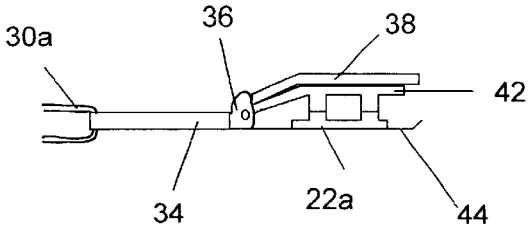
FIG. 3 is the side view of a vest-clip in a closed position.

FIG. 3 shows a side view of vest-clip 22*a* with its jaws closed. Upper jaw 42 of clip 22*a* may or may not carry several teeth or grooves to improve holding. Likewise, lower jaw 44 may or may not carry improved means for holding onto clothing material.

Figure 4:
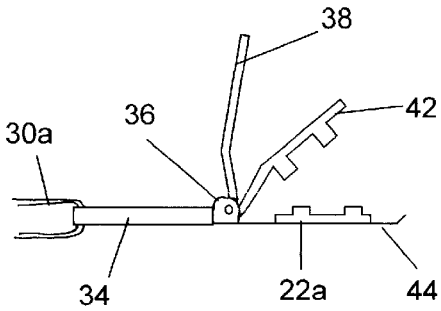
FIG. 4 is the side view of a vest-clip in an open position.

FIG. 4 shows a side view of the vest-clip 22*a* with its jaws open. When jaw cover 38 is rotated upward about hinge 36, upper jaw 42 lifts off away from lower jaw 44. While in this position, a fold of fabric maybe placed between the jaws. Jaw cover 38 can then be rotated about hinge 36 until upper jaw 42 snaps shut on lower jaw 44.

Figure 5:
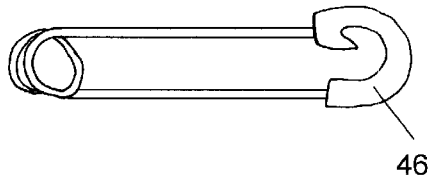
FIG. 5 is the top view of an ordinary safety pin.

FIG. 5 shows an ordinary, commercially available safety-pin 46 that can be used in place of the vest-clips described above. In that case, two safety pins would replace vest-clips 22*a* and 22*b* shown in FIG. 1.

Figure 6:
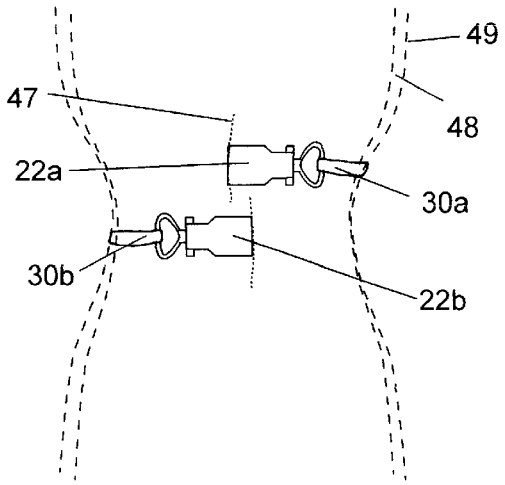
FIGS. 6 and 7 illustrate two ways how the wrap belt can be worn on a dress.
Figure 7:
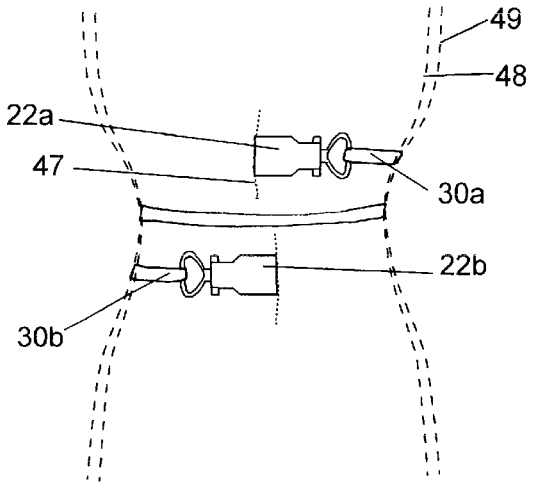

FIGS. 6 and 7 show two examples of the use of wrap belt 28. Torso 48 of a wearer is draped in loose garment 49. Vest-clip 22*a* is first attached to the garment. Wrap belt 28 is then circled around the torso until it cannot be wrapped further. At that point, vest-clip 22*b* is attached to the garment. In FIG. 6, the wrap belt encircles the torso only partially. In FIG. 7, the wrap belt encircles the torso more than once. A slight pleat or fold 47 may be formed to help the clip grab the garment of the wearer. Buckle 26 of FIG. 1 may be used to adjust the length of the wrap-belt depending on the look desired.

Figure 8:
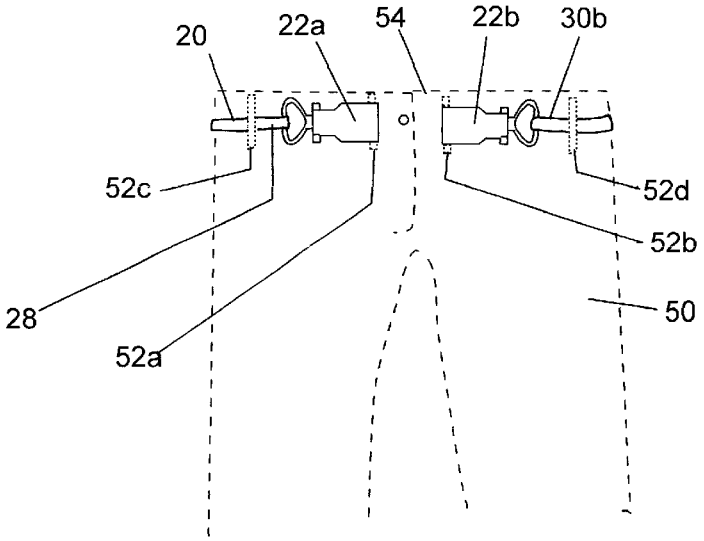
FIG. 8 shows how a wrap belt can be worn on a trouser.

FIG. 8 shows a pair of trousers 50. The trousers have several belt loops 52*a,* 52*b,* 52*c* and 52*d* visible along the waistband. Vest-clips 22*a* and 22*b* are attached to loops 52*a* and 52*b,* respectively. This allows closure 54 on trousers to be opened or closed without having to unfasten belt 28.

Figure 9:
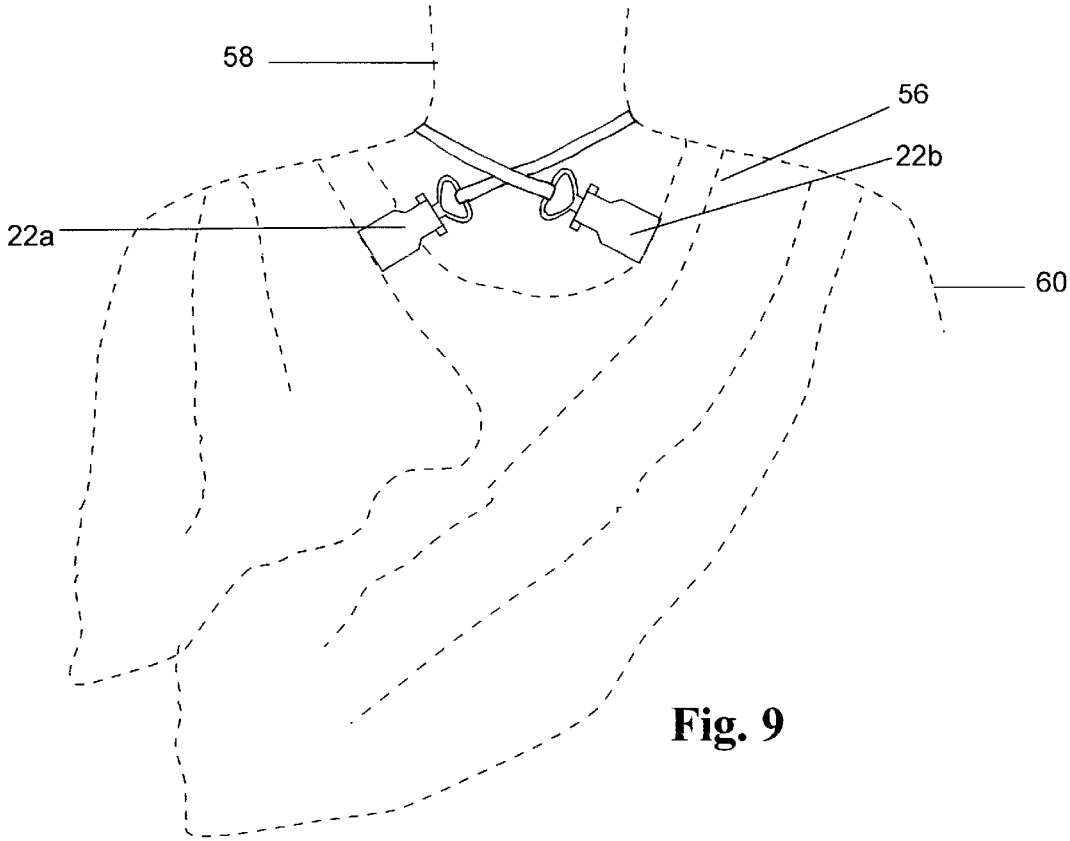
FIG. 9 shows how a wrap belt can be used to hold a shawl in place on the shoulders.

FIG. 9 shows the use of a wrap belt to secure a shoulder wrap or shawl 56. Wrap 56 is draped around shoulders 60 of the wearer. The wrap belt is then adjusted to the right length and placed around neck 58 of the wearer. Vest-clip 22*a* is attached to one end of wrap 56 while vest-clip 22*b* is attached to the other end of wrap 56. This secures the shoulder wrap comfortably and prevents it from requiring constant readjustment.

Figure 10:
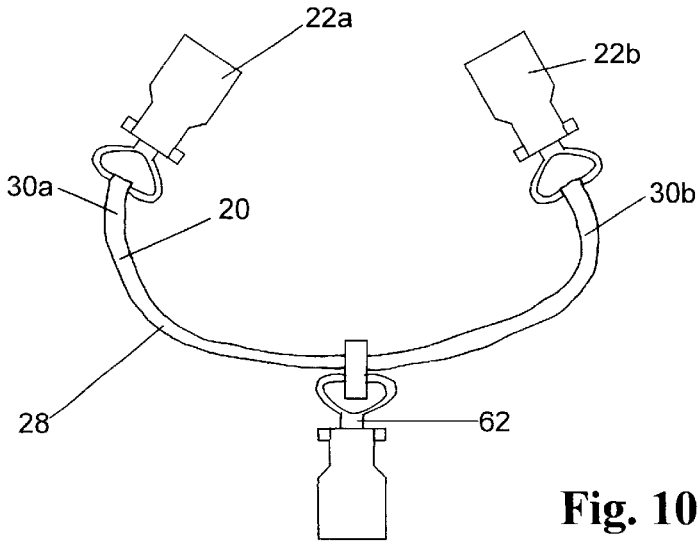
FIG. 10 shows a wrap belt with more than two vest-clips.

FIG. 10 shows an embodiment of the wrap belt where an extra vest-clip 62 may be placed on the length of wrap belt 28 to provide further points of attachment to an article of clothing. In fact several vest-clips similar to vest-clip 62 may be attached along the length of the wrap belt. One example use of such an embodiment would be in converting a length of material into a sarong skirt.

Operation of the Invention

In using the wrap belt:

1. The wearer first picks the point of placement for the first vest-clip.
2. She then pinches a small amount of fabric at that position and places it between the open jaws of the vest clip. In order to firmly hold the fabric in the clip, she closes the jaws of the vest-clip by pressing on jaw cover 38 as shown in FIGS. 3 and 4. The jaws remain shut unless force is applied on jaw cover 38 to separate upper jaw 42 from lower jaw 44.
3. The wearer then wraps the belt around her waist one or more times depending on the length of the wrap belt. At this point she may adjust the length of the belt by means of buckle 26 to a desired length. The length of the belt may also be adjusted prior to step 1 described above.
4. She then pinches a small amount of fabric near the free end of the belt and fastens the vest-clip to the pinched fabric in a manner similar to that described in step 2 above. At this point the wearer may further adjust the length of the belt by means of buckle 26.

In the steps described above, the vest-clip could be replaced by any other fastening means such as a safety pin, a claw pin, or any other commonly available means. For example a hook may be used on a knit or other open-weave article of clothing. Likewise, a crocodile clip resembling laundry pegs may be used. Decorative brooch-like pins may be used in place of the vest-clips described above. Alternatively a spring-loaded key-chain holder may be used in place of the vest-clips.

The use of the wrap belt is not restricted to the waist. As shown in FIG. 9, the wrap belt may be used to hold a shoulder-wrap in place.

In an alternative embodiment of the wrap belt, several vest-clips may be attached along the length of the belt. This embodiment may be used to convert any piece of material into a sarong skirt or a torso wrap.

In yet another embodiment, several loops with attached vest-clips may be provided along with the belt. These loops may be slipped onto the belt when needed. Therefore the number of clips on the belt may be increased or decreased depending on the use it is being subjected to.

While certain novel features of this invention have been shown and described, it is not intended to be limited to the details above, since it will be understood that various omissions, modifications, substitutions and changes in the forms and details of the device illustrated and its operations can be made by those skilled in the art without departing in any way from the spirit of the present invention.

Conclusion, Ramifications, and Scope of Invention

Thus the reader will see that the wrap belt of this invention provides a versatile article of wear that can result in several looks while adding convenience. It is a novel form of belt where the two ends of the belt can be attached to the wearer's clothing instead of forming the closed loop of a traditional belt. This ability of the wrap belt to attach itself to a wearer's clothing presents several advantages. Firstly, since the belt is attached directly to clothing, the clothing does not move substantially with respect to the belt. This reduces any bunching of fabric. When a closed-loop belt is worn on a loose dress, the dress may, as the day progresses, move horizontally or vertically with respect to the belt resulting in a look very different from the one the wearer intended. Instead, if the wearer uses the wrap belt of the present invention, the dress will not move substantially with respect to the belt since the belt is attached to the clothing. This will help maintain the look that the wearer had started out with. Secondly, when worn on clothing that has belt loops, the two ends of the belt can attach to the loops. For instance, the fastening means at one end of the belt can be made to grab the belt-loop to the left of the zipper opening of a trouser; the second fastening means can be made to grab the belt-loop to the right of the zipper with the belt encircling the waist in an open circle leaving the zippered opening unhindered by the belt. This would allow the wearer to remove the clothing on which the belt is worn without having to unbuckle the belt. A wrap belt thus worn would also help avoid the bulk that most belts cause right on the stomach because of their buckle. Aside from these advantages, the two fastening means at the two ends of the belt can be used to securely hold onto a sarong that is worn wrapped around the torso. The wrap belt can also be used to help secure a shawl or shoulder wrap.

Aside from the many practical examples mentioned above, the wrap belt of this invention introduces a highly decorative as well as practical fashion accessory to a market that is highly receptive to novel items of wear.

While my above description contains many specifics, these should not be construed as limitations on the scope of the invention, but rather as an example of preferred embodiment thereof. For example, the belt material of the wrap belt could be made elastic. Or it could be a cord with a circular cross-section or any other cross-section. It could be a single piece of material. Or it could consist of a number of jointed pieces. It could be made of any color or pattern. The buckle used for adjusting the length may be eliminated entirely. Other adjusting means like Velcro(TM) may be used instead. The belting material could have serrated or wavy edges. Alternatively, it could be made very wide. The belting material may be attached to the fasteners by sewing or gluing or metal studs or other equivalent means. In yet another embodiment, the fasteners and the belting material could all be made from one single piece of material, a flexible plastic for instance.

What is claimed is:

1. A novel belt that can attach itself to a wearer's clothing, said belt comprising (a) a length of flexible material (b) said length of flexible material having a first end and a second end (c) said first end carrying a first fastening means for attaching said first end to wearer's clothing (d) said second end carrying a second fastening means for attaching said second end to wearer's clothing (e) said length of flexible material being of sufficient length to go at least halfway around the waist of the wearer.

2. The belt of claim 1 wherein said length of flexible material carries at least one adjusting means for varying the length of said belt.

3. The belt of claim 2 wherein said adjusting means can be selected from the group consisting of: buckles, hook and loop fasteners, buttons, and other equivalent means.

4. The belt of claim 1 wherein the first fastening means and the second fastening means can be selected from the group consisting of: vest-clips, lobster claws, safety pins, hook and loop fasteners, buttons, dog-leash clips, luggage-strap clips, and other equivalent means.

5. The belt of claim 1 wherein said length of flexible material is of sufficient length to go more than once around the waist of a wearer.

6. The belt of claim 1 wherein said length of flexible material is made of a material selected from the group consisting of: leather, elastic, fabric, plastic, and other equivalent means.

7. The belt of claim 1 wherein at least one additional fastening means is present intermediate the first fastening means and the second fastening means.

8. A novel belt that can attach itself to a wearer's clothing, said belt comprising (a) a length of flexible material (b) a first fastening means present on said length of flexible material for attaching said length of flexible material to wearer's clothing (c) a second fastening means present on said length of flexible material for attaching said length of flexible material to wearer's clothing (d) said length of flexible material being of sufficient length to go at least halfway around the waist of the wearer.

9. The belt of claim 8 wherein said length of flexible material carries at least one adjusting means for varying the length of said belt.

10. The belt of claim 9 wherein said adjusting means can be selected from the group consisting of: buckles, hook and loop fasteners, buttons, and other equivalent means.

11. The belt of claim 8 wherein the first fastening means and the second fastening means can be selected from the group consisting of: vest-clips, lobster claws, safety pins, hook and loop fasteners, buttons, dog-leash clips, luggage-strap clips, and other equivalent means.

12. The belt of claim 8 wherein said length of flexible material is of sufficient length to go more than once around the waist of a wearer.

13. The belt of claim 8 wherein said length of flexible material is made of a material selected from the group consisting of: leather, elastic, fabric, plastic, and other equivalent means.

14. The belt of claim 8 wherein at least one additional fastening means is present intermediate the first fastening means and the second fastening means.

15. A method of wearing a belt that includes a length of flexible material, a first fastening means and a second fastening means, said method comprising:

(a) attaching said first fastening means to a wearer's clothing (b) wrapping said length of flexible material around the torso of the wearer (c) attaching said second fastening means to the wearer's clothing whereby the clothing of the wearer is held securely and comfortably by the belt.

16. The method of claim 15 wherein said method includes adjusting the length of the belt by using an adjusting means included on the belt.

* * * * *

UNITED STATES PATENT AND TRADEMARK OFFICE

CERTIFICATE OF CORRECTION

PATENT NO. : 6,389,605 B2
DATED : May 21, 2002
INVENTOR(S) : Priti Srivastava

It is certified that error appears in the above-identified patent and that said Letters Patent is hereby corrected as shown below:

Column 6, Line 49 - Column 8, Line 14,
Claims 8-16, should read:
-- 8. (Amended) A novel belt that can attach itself to a wearer's clothing, said belt comprising (a) a length of flexible material
(b) said length of flexible material having a first end and a second end
(c) said first end carrying a first fastening means for attaching said first end to wearer's clothing (d) said second end carrying a second fastening means for attaching said second end to wearer's clothing
(e) said length of flexible material being configured so as to be enabled to at least significantly encircle the waist of the wearer.

9. (No change) The belt of claim 8 wherein said length of flexible material carries at least one adjusting means for varying the length of said belt.

10. (Amended) The belt of claim 9 wherein said adjusting means can be selected from the group consisting of: buckles, hook and loop fasteners, and buttons.

11. (Amended) The belt of claim 8 wherein the first fastening means and the second fastening means can be selected from the group consisting of: vest-clips, lobster claws, safety pins, hook and loop fasteners, buttons, dog-leash clips and luggage-strap clips.

12. (No change) The belt of claim 8 wherein said length of flexible material is of sufficient length to go more than once around the waist of a wearer.

13. (Amended) The belt of claim 8 wherein said length of flexible material is made of a material selected from the group consisting of: leather, metal, elastic, fabric and plastic.

14. (Amended) The belt of claim 8 wherein at least one additional fastening means is present along the length of the flexible material intermediate the first fastening means and the second fastening means.

15. (Canceled) The belt of claim 8 wherein at least one of the first fastening means and the second fastening means is present adjustably with respect to the length of flexible material.

UNITED STATES PATENT AND TRADEMARK OFFICE

CERTIFICATE OF CORRECTION

PATENT NO. : 6,389,605 B2
DATED : May 21, 2002
INVENTOR(S) : Priti Srivastava

It is certified that error appears in the above-identified patent and that said Letters Patent is hereby corrected as shown below:

16. (Amended) A novel belt that can attach itself to a wearer's clothing, said belt comprising
(a) a length of flexible material
(b) a first fastening means present on said length of flexible material for attaching said length of flexible material to wearer's clothing
(c) a second fastening means present on said length of flexible material for attaching said length of flexible material to wearer's clothing
(d) said length of flexible material being configured so as to be enabled to at least significantly encircle the waist of the wearer. --

Column 8,
Beginning after claim 16, insert claims 17-25,
-- 17. (No change) The belt of claim 16 wherein said length of flexible material carries at least one adjusting means for varying the length of said belt.

18. (Amended) The belt of claim 17 wherein said adjusting means can be selected from the group consisting of: buckles, hook and loop fasteners and buttons.

19. (Amended) The belt of claim 16 wherein the first fastening means and the second fastening means can be selected from the group consisting of: vest-clips, lobster claws, safety pins, hook and loop fasteners, buttons, dog-leash clips and luggage-strap clips.

20. (No change) The belt of claim 16 wherein said length of flexible material is of sufficient length to go more than once around the waist of a wearer.

21. (Amended) The belt of claim 16 wherein said length of flexible material is made of a material selected from the group consisting of: leather, metal, elastic, fabric and plastic.

22. (Amended) The belt of claim 16 wherein at least one additional fastening means is present along the length of the flexible material intermediate the first fastening means and the second fastening means.

23. (Canceled) The belt of claim 16 wherein at least one of the first fastening means and the second fastening means is present adjustably with respect to the length of flexible material.

UNITED STATES PATENT AND TRADEMARK OFFICE

CERTIFICATE OF CORRECTION

PATENT NO. : 6,389,605 B2
DATED : May 21, 2002
INVENTOR(S) : Priti Srivastava

It is certified that error appears in the above-identified patent and that said Letters Patent is hereby corrected as shown below:

24. (Amended) A method of wearing a belt that includes a length of flexible material, a first fastening means and a second fastening means, said method comprising:

(a) attaching said first fastening means to a wearer's clothing (b) wrapping said length of flexible material around the torso of the wearer so as to at least significantly encircle the waist of the wearer.

(c) attaching said second fastening means to the wearer's clothing whereby the clothing of the wearer is held securely and comfortably by the belt.

25. (No change) The method of claim 24 wherein said method includes adjusting the length of the belt by using an adjusting means included on the belt. --

Signed and Sealed this

Seventeenth Day of December, 2002

JAMES E. ROGAN
*Director of the United States Patent and Trademark Office*